US005179878A

United States Patent [19]

Kranefeld et al.

[11] Patent Number: 5,179,878

[45] Date of Patent: Jan. 19, 1993

[54] METHOD AND APPARATUS FOR SEVERING TIES AND WRAPPERS OF TEXTILE FIBER BALES

[75] Inventors: Andreas Kranefeld, Erkelenz; Josef Temburg, Jüchen; Abi Marom, Mönchengladbach, all of Fed. Rep. of Germany

[73] Assignee: Trützschler GmbH & Co. KG, Mönchengladbach, Fed. Rep. of Germany

[21] Appl. No.: 745,211

[22] Filed: Aug. 15, 1991

[30] Foreign Application Priority Data

Aug. 16, 1990 [DE] Fed. Rep. of Germany ..... 4025890
Jun. 12, 1991 [DE] Fed. Rep. of Germany ..... 4119336

[51] Int. Cl.[5] ..... B65B 69/00

[52] U.S. Cl. ..... 83/13; 29/426.4; 29/564.3; 83/607; 83/349; 83/909

[58] Field of Search ..... 83/909, 349, 13, 607; 29/564.3, 426.4; 414/412

[56] References Cited

U.S. PATENT DOCUMENTS

| | | | |
|---|---|---|---|
| 2,820,282 | 1/1958 | Schneider, Jr. | 29/200 |
| 3,513,522 | 5/1970 | Thomson | 29/200 |
| 3,763,748 | 10/1973 | Gallagher, Jr. | 83/349 X |
| 4,348,801 | 9/1982 | Dumort et al. | 83/909 X |
| 4,696,615 | 9/1987 | Ettischer et al. | 414/412 X |
| 4,718,157 | 1/1988 | Keyzers et al. | 83/909 X |
| 4,773,148 | 9/1988 | Ohya et al. | 83/909 X |
| 4,841,619 | 6/1989 | Theriault | 83/909 X |
| 4,932,296 | 6/1990 | Boone | 83/607 X |
| 4,976,583 | 12/1990 | Moltrasio | 83/909 X |

FOREIGN PATENT DOCUMENTS

| | | |
|---|---|---|
| 0195471 | 9/1986 | European Pat. Off. . |
| 0251414 | 1/1988 | European Pat. Off. . |
| 2803572 | 6/1983 | Fed. Rep. of Germany . |
| 3404794 | 8/1985 | Fed. Rep. of Germany . |
| 3504768 | 8/1985 | Fed. Rep. of Germany . |
| 2013124 | 8/1979 | United Kingdom . |

*Primary Examiner*—Frank T. Yost
*Assistant Examiner*—Kenneth E. Peterson
*Attorney, Agent, or Firm*—Spencer, Frank & Schneider

[57] ABSTRACT

An apparatus for severing ties or a wrapper surrounding a fiber bale includes a severing device having a cutting element and a drive for actuating the cutting element; a counterelement positioned adjacent the cutting device; a supporting device for positioning the fiber bale; and a displacing device for moving the severing device and the cutting device as a unit relative to the supporting device for causing the counterelement to penetrate into the fiber bale underneath the tie to countersupport the tie during severing of the tie by the severing device.

16 Claims, 8 Drawing Sheets

FIG. 2
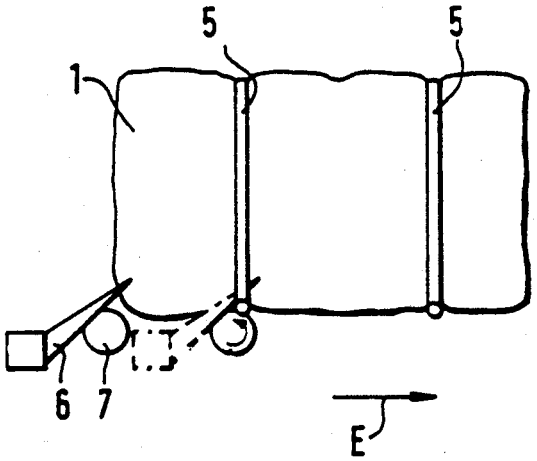
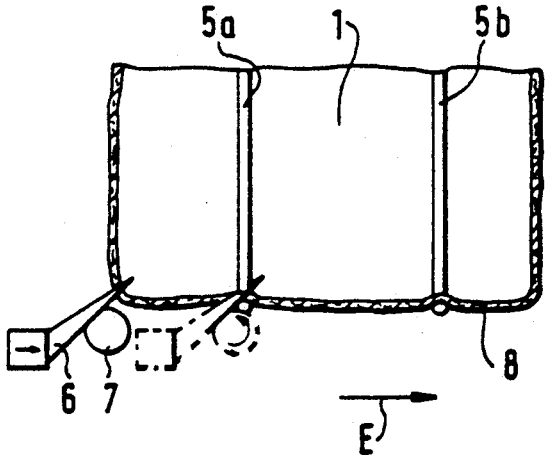
FIG. 3
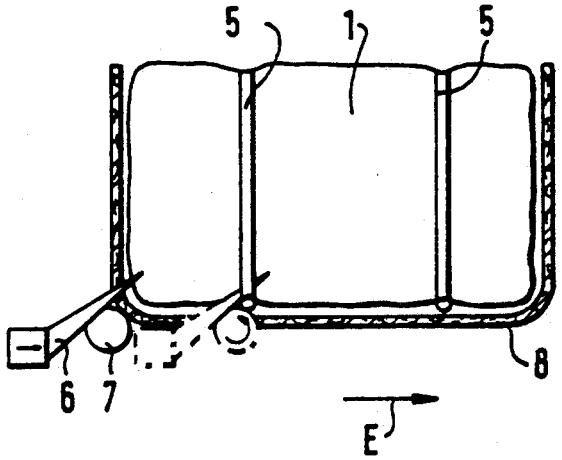
FIG. 4

METHOD AND APPARATUS FOR SEVERING TIES AND WRAPPERS OF TEXTILE FIBER BALES

CROSS REFERENCE TO RELATED APPLICATION

This application claims the priority of German Application Nos. P 40 25 890.4 filed Aug. 16, 1990 and P 41 19 336.9 filed Jun. 12, 1991, which are incorporated herein by reference. This application further contains subject matter related to a United States application filed concurrently with this application and based on German Application Nos. P 40 25 889.0 filed Aug. 16, 1990 and P 41 19 158.7 filed Jun. 11, 1991.

BACKGROUND OF THE INVENTION

This invention relates to a method and an apparatus for severing securing ties such as wires, straps or bands and/or the wrapper of textile fiber bales, particularly cotton bales and chemical fiber bales. The fiber bales and a severing device for the ties and/or the wrapper are moved relative to one another and at least one severing element of the severing device is driven.

In a known arrangement a pneumatically rapidly accelerated chisel is impacting the bale tie. Such a method, however, cannot be used universally; in particular, in case of relatively soft textile fiber bales, the ties may be pressed into the soft fiber material without a complete severance. It is a further disadvantage of the prior art structures that they do not permit a continuous operation.

SUMMARY OF THE INVENTION

It is an object of the invention to provide an improved method and apparatus of the above-outlined type from which the discussed disadvantages are eliminated and which, in particular, may find universal application and ensures a secure severing of the bale ties.

This object and others to become apparent as the specification progresses, are accomplished by the invention, according to which, briefly stated, the apparatus for severing ties or a wrapper surrounding a fiber bale includes a severing device having a cutting element and a drive for actuating the cutting element; a counterelement positioned adjacent the cutting device; a supporting device for positioning the fiber bale; and a displacing device for moving the severing device and the cutting device as a unit relative to the supporting device for causing the counterelement to penetrate into the fiber bale underneath the tie to countersupport the tie during severing of the tie by the severing device.

By virtue of the fact that the severing device cooperates with a counterelement which extends below the tie, the latter is prevented from avoiding the severing device during the severing operation. In this manner a secure severing of the tie is ensured regardless of the type or firmness of the fiber bale. It is a further advantage of the invention that by virtue of the penetration and travel of the counterelement with the severing device, a continuous operation is ensured.

BRIEF DESCRIPTION OF THE DRAWING

FIG. 2 is a top plan view of a wrapperless fiber bale, provided with ties and being engaged by severing components according to the invention.

FIG. 3 is a top plan view of a wrapped fiber bale, provided with ties extending above the wrapper, and being engaged by components of the severing device according to the invention.

FIG. 4 is a top plan view of a wrapped fiber bale provided with ties extending underneath the wrapper and being engaged by components of the severing device according to the invention.

DESCRIPTION OF THE PREFERRED EMBODIMENTS

Figure 1:
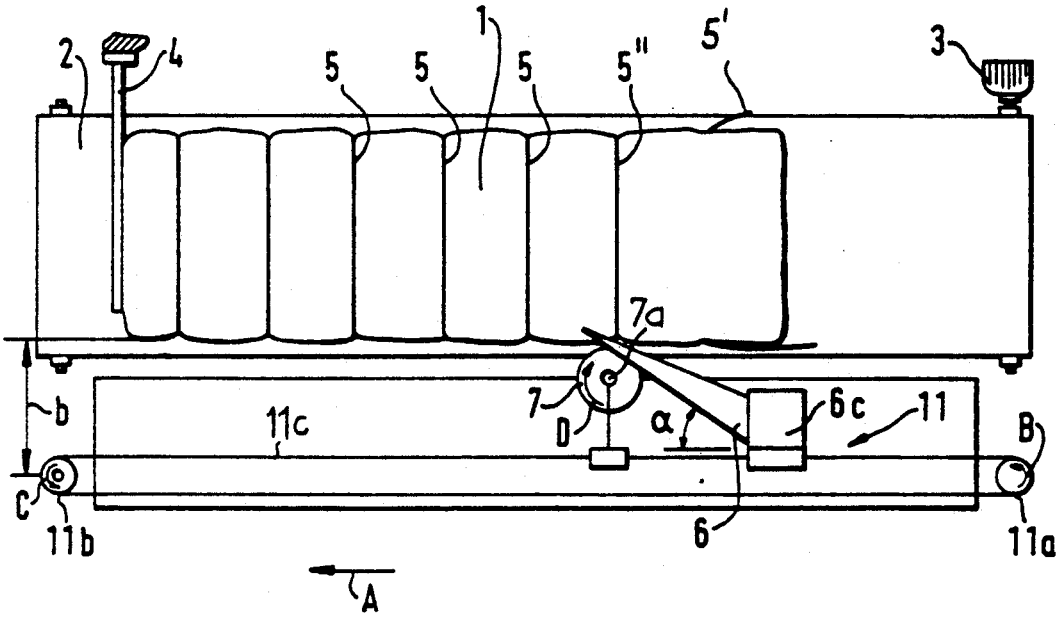
FIG. 1 is a schematic top plan view of a preferred embodiment of the invention, showing a travelling severing device and stationarily supported fiber bales.

FIG. 1 shows a textile fiber bale 1 which is positioned stationarily on a conveyor belt 2 driven by a motor 3. A bale retaining device 4 which is stationarily supported externally of the belt 2 and which can be pivoted into and out of the illustrated operative position, forms a counterpressure surface at one end of the fiber bale 1. The fiber bale 1 is surrounded by a plurality of securing ties 5 which are under significant circumferential tension. A counterelement, such as a spike 6 which may be, for example, 20 cm long, is attached at its root to a spike block 6*c* which is secured to an endless carrier element, such as a chain 11*c* of a carrier device generally designated at 11. The spike 6 is oriented at an angle $\alpha$ to its travelling direction A as advanced by the carrier device 11. The pointed end of the spike 6 is oriented towards the fiber bale 1. The chain 11*c* is supported by two opposite end rollers 11*a*, 11*b* rotating in the direction as indicated by respective arrows B and C. A cutting wheel 7, slowly rotated in the direction D and also mounted on the chain 11c is propelled in unison with the spike 6 and cooperates therewith. The spike 6 and the cutting wheel 7 are in an overlapping relationship with one another. The cutting wheel 7 has a rotary axis 7a which is perpendicular to the travelling direction A. As seen in the top plan illustration of FIG. 1, the cutting wheel 7 and the counterelement 6 are supported laterally of the conveyor belt 2 for engaging and severing the ties 5 on a lateral, vertical face of the fiber bale 1.

In operation, the travelling spike 6 penetrates the surface of the fiber bale 1 and extends underneath the tie 5 which, as a result, is slightly pulled away from the bale surface. Thereafter, the tie 5 is introduced into the gap between the spike 6 (which has a cutting edge) and the driven cutting wheel 7, whereby the tie 5 is severed between the two cutting edges. In FIG. 1 a severed tie is designated at 5', while a tie on which the cutting operation is just being performed is designated at 5''. The cross-sectional surface of the severed wire has at its edge two bright cut surfaces and a mat ruptured surface. This indicates that first the wire is nicked by the severing device and then torn apart by the significant tension in the wire.

FIGS. 2, 3 and 4 illustrate a severing device formed of the spike 6 and the cutting wheel 7 which is moved in the direction of the arrow E while the bale 1 is immobilized. In all three FIGS. 2, 3 and 4 the solid-line illustration of the cutting device 6, 7 shows the moment of penetration of the spike 6 into the bale surface while the phantom-line illustration shows the cutting device at the moment of the severing operation, while the spike 6 is situated underneath the tie 5. FIG. 2 shows a wrapperless fiber bale 1 surrounded by ties 5, FIG. 3 shows a fiber bale 1 with a wrapper 8, surrounded by the ties 5, while FIG. 4 shows a fiber bale 1 with a wrapper 8 surrounding the ties 5. The wrapper 8 is pierced by the spike 6 and, as the spike 6 is further conveyed in the direction of arrow E, it rips open the wrapper 8.

Figure 5A:
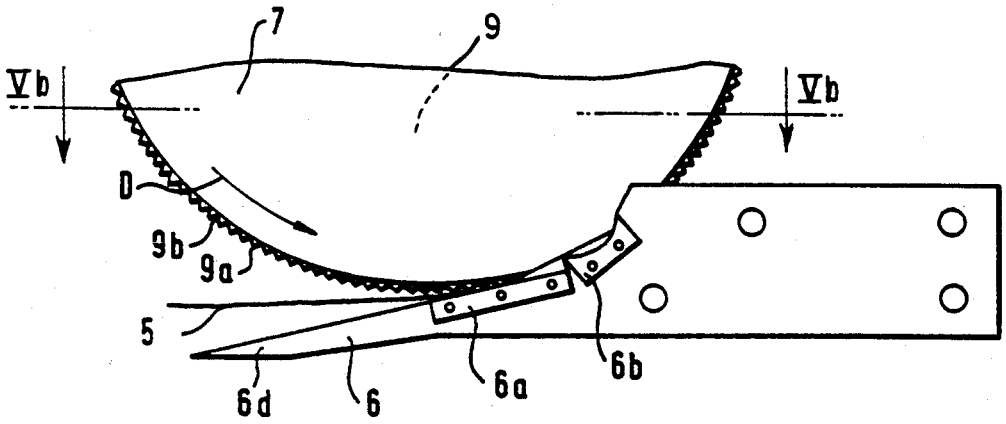
FIG. 5*a* is a schematic side elevational view of a preferred embodiment of a severing device including a rotatable cutting wheel, a toothed disc and a counterelement provided with knife blades.
Figure 5B:
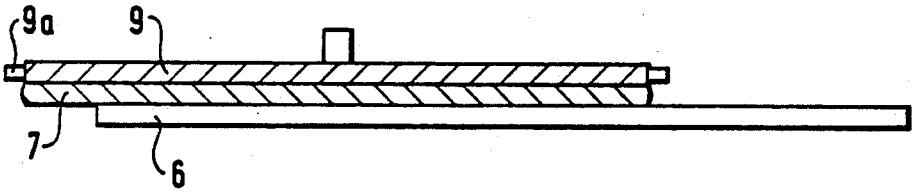
FIG. 5*b* is a sectional view taken along line Vb—Vb of FIG. 5*a*.

Turning to FIGS. 5a and 5b, the spike 6 has a wear-resistant cutting face 6a made, for example, of hard metal. The spike 6 cooperates with the rotary cutting wheel 7 which is in a face-to-face engagement, on the surface remote from the spike 6, with a disc 9 which has on its periphery teeth 9a, alternating with tooth gaps 9b. The teeth 9a and the tooth gaps 9b radially project beyond the circumference of the cutting wheel 7. In operation, one of the tooth gaps 9b holds the tie 5 in a form-fitting manner such that it cannot escape while the cutting face 6a of the spike 6 and the cutting wheel 7 together perform the severing operation. The tooth gaps 9b thus serve as carriers as well as counter-supports for the ties 5. Behind the knife edge 6a an auxiliary knife edge 6b is provided for cutting open the fiber bale wrapper.

Figure 6:
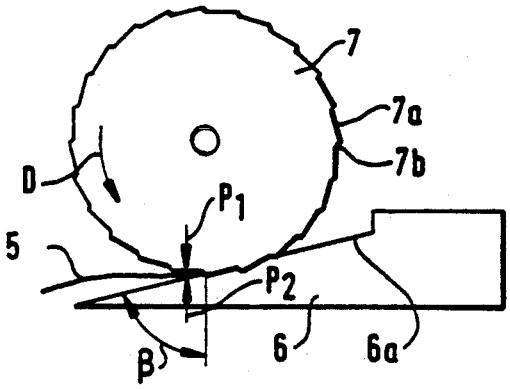
FIG. 6 is a schematic side elevational view of another preferred embodiment of a spike-like counterelement and a rotatable toothed cutting wheel.

In FIG. 6 the cutting wheel 7 of the severing device has, along its circumference, angled tooth flanks 7a which are oriented in their working position substantially parallel to the cutting edge 6a of the spike 6. In this manner, substantially linearly applied pressures $P_1$ and $P_2$ are exerted on the tie 5 from both sides. The cutting edge 6a of the spike 6 forms an acute angle B with the wheel diameter 7c drawn to the initial point of overlap 7d between the wheel 7 and the knife edge 6a.

Figure 7:
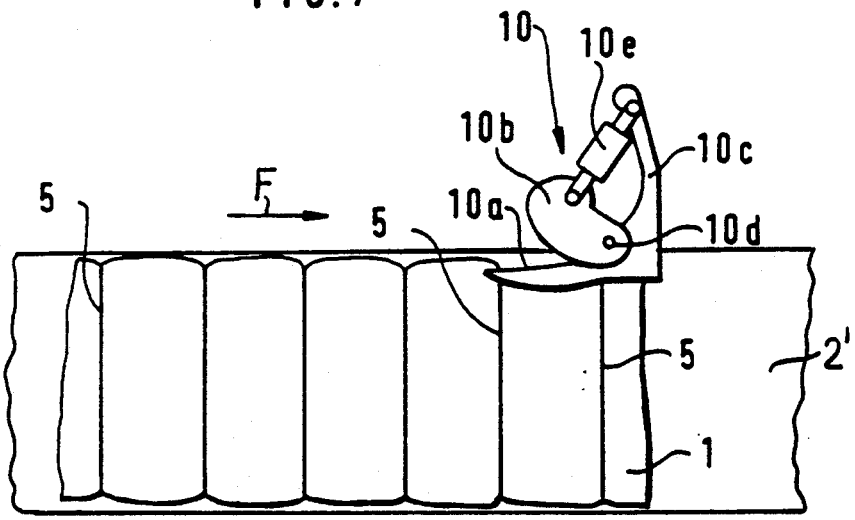
FIG. 7 is a schematic top plan view of another preferred embodiment of the severing device.

FIG. 7 shows severing shears 10 for cutting the ties 5. The severing shears 10 have two cutting blades 10a and 10b. The cutting blade 10a which extends underneath the tie 5 is arranged at the end of a cutter frame 10c. The cutting blade 10b which is rotatably secured to the frame 10c by a pivot 10d is operated by a pneumatic cylinder 10e which is, at one end, supported on the frame 10c. In this embodiment the severing device (shears) 10 is held stationarily, while the fiber bale 1 is advanced by a conveyor belt 2' in the direction F.

Figure 8:
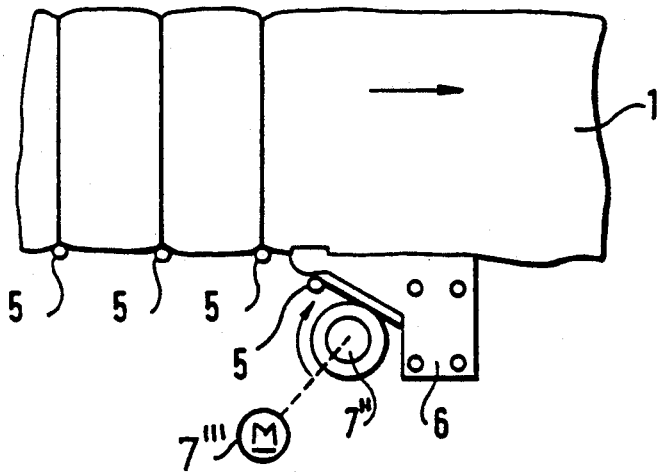
FIG. 8 is a schematic top plan view of a still another preferred embodiment, formed of a cutting wheel and a finger-shaped blade.
Figure 9A:
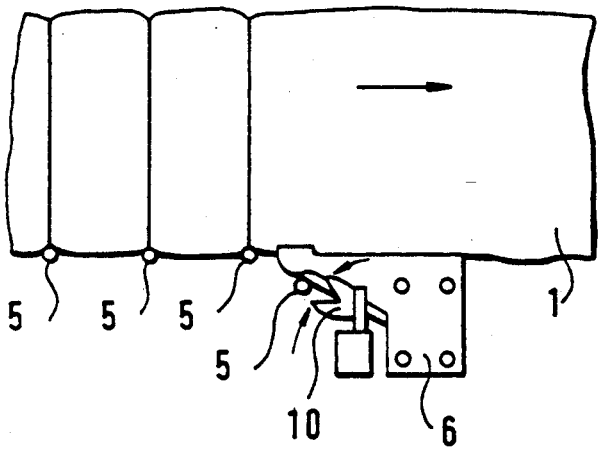
FIG. 9*a* is a schematic top plan view of yet a further preferred embodiment of the invention, including a stationary severing device with shears and a finger-shaped knife according to the invention.
Figure 9B:
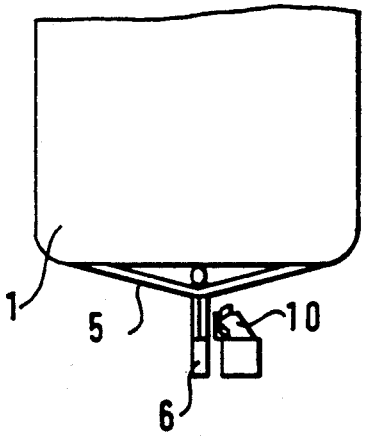
FIG. 9*b* is a schematic side elevational view of the construction shown in FIG. 9*a*.
Figure 10:
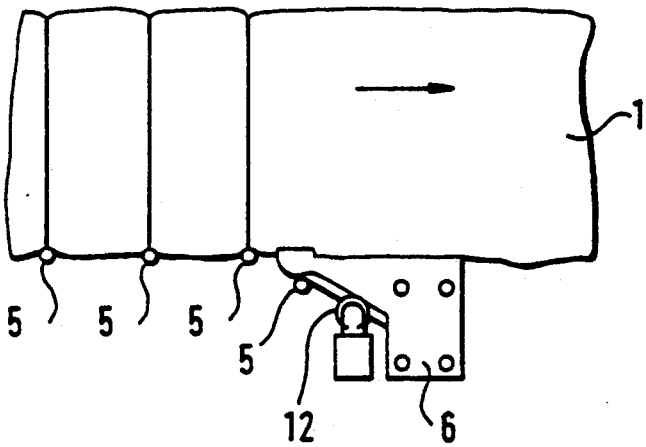
FIG. 10 is a schematic top plan view of still another preferred embodiment of the invention.

In FIG. 8, the severing device comprises a cutting wheel 7'' which has a sharpened circumference that cooperates with the cutting blade 6a' of a finger-shaped knife 6' and which is driven by a motor 7'''. The cutting wheel 7 and the knife 6' may cooperate with one another without an overlap. The knife 6' has a spike portion 6b' which lifts the tie 5 off the bale surface. Instead of a cutting wheel 7'', the finger-shaped knife 6' may cooperate with shears 10 (FIGS. 9a, 9b) or with a rapidly rotating grinding wheel 12 (FIG. 10).

Figure 11A:
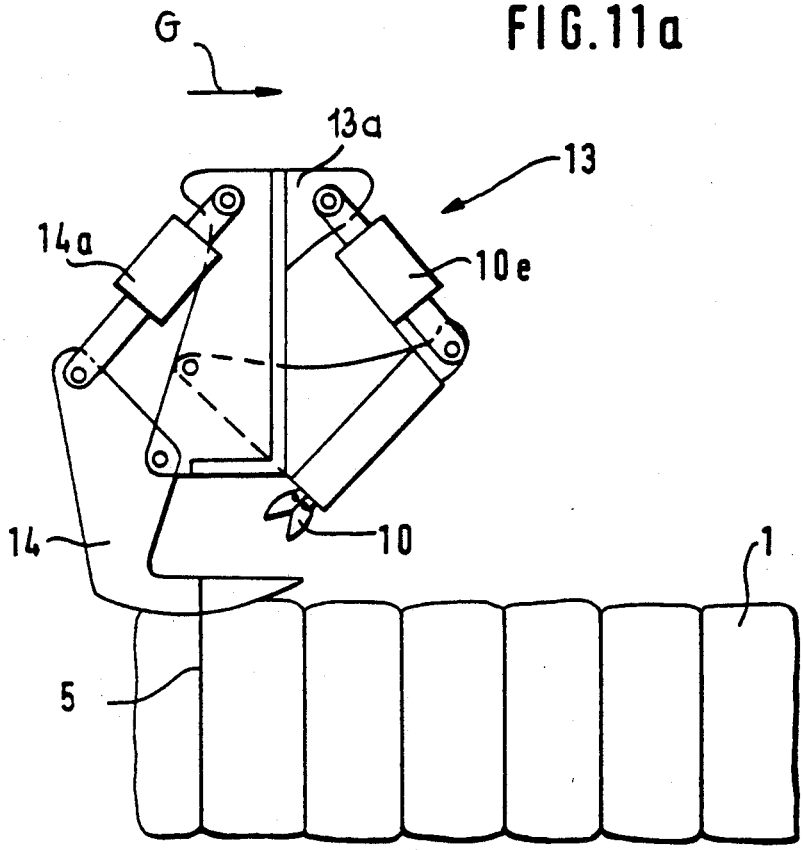
FIG. 11*a* is a schematic side elevational view of another preferred embodiment of the invention.
Figure 11B:
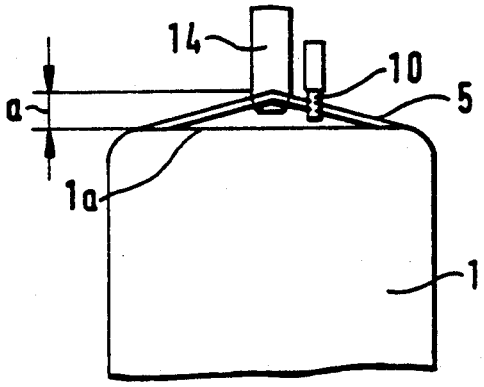
FIG. 11*b* is a schematic front elevational view of the structure shown in FIG. 11*a*.

FIG. 11a illustrates a travelling cutting device 13 having a frame 13a and being movable in the direction of the arrow G. The frame 13a pivotally supports a penetrating hook 14 operated by a hydraulic cylinder 14a and shears 10 operated by a hydraulic cylinder 10e. As shown in FIG. 11b, the hook 14 lifts the tie 5 off the bale surface 1a through a distance a.

Figure 12A:
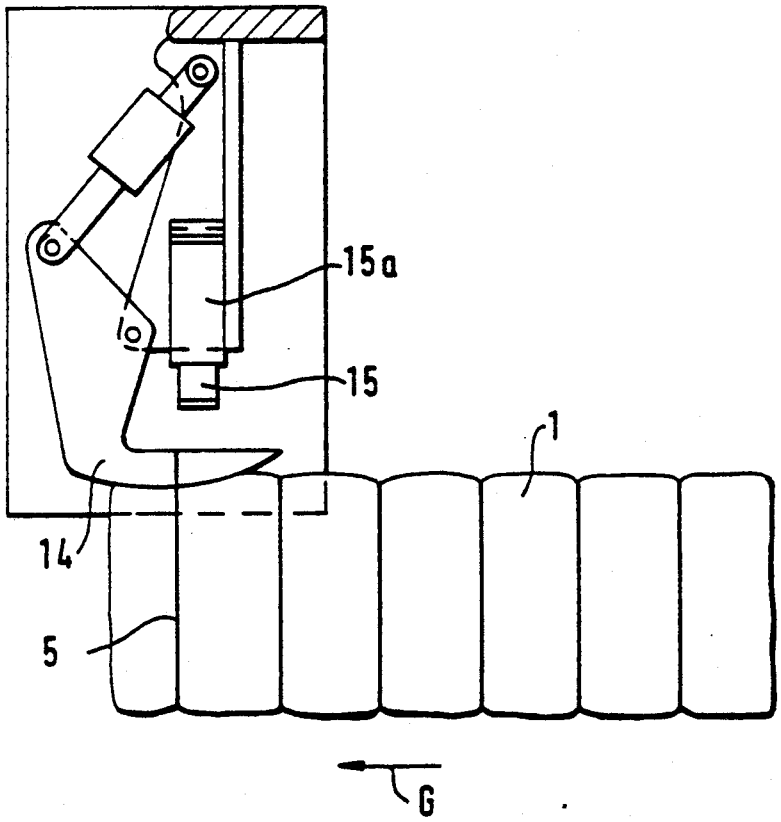
FIG. 12*a* is a schematic side elevational view of yet another preferred embodiment, including a percussion knife.
Figure 12B:
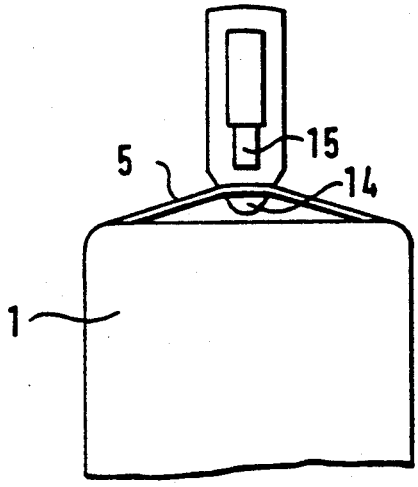
FIG. 12*b* is a schematic front elevational view of the structure shown in FIG. 12*a*.

In the embodiment shown in FIGS. 12a and 12b, the hook 14 cooperates as a counterelement with a percussion knife 15 which is accelerated by a pneumatic cylinder 15a.

Figure 13:
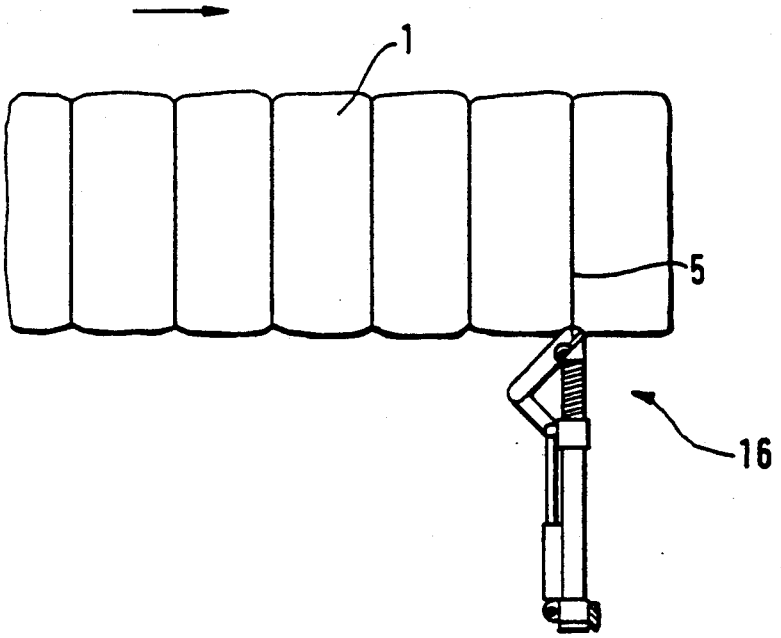
FIG. 13 is a schematic top plan view of a further preferred embodiment, including parallel shears.

Turning to the embodiment illustrated in FIG. 13, parallel shears 16 are provided as the severing device for the tie 5.

Figure 14:
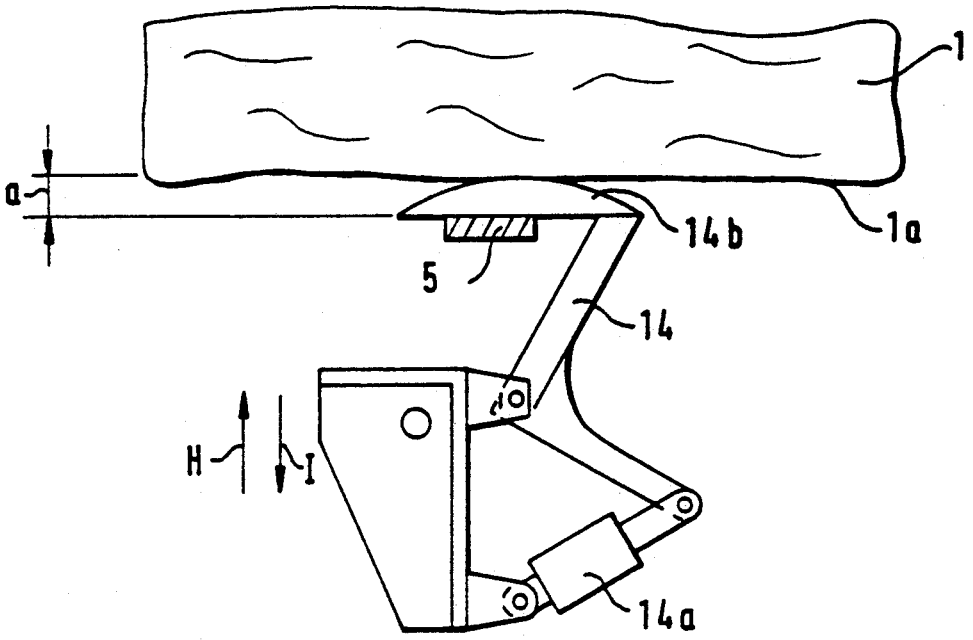
FIG. 14 is a schematic top plan view of a hook component of a further preferred embodiment.

FIG. 14 shows the hook 14 which is movable in the direction of the arrow H in engagement with the bale 1. Thereafter, the angled end 14b of the hook 14 is pressed in the hook 14 is pulled away from the bale 1 in the direction of the arrow I so that the tie 5 is pulled immediately from the bale surface la through a distance a.

It will be understood that the above description of the present invention is susceptible to various modifications, changes and adaptations, and the same are intended to be comprehended within the meaning and range of equivalents of the appended claims.

What is claimed is:

1. A method of severing ties or a wrapper surrounding a fiber bale, comprising the following steps:

(a) displacing the fiber bale and a severing device relative to one another for feeding the ties sequentially to the severing device;

(b) slowly rotating a cutting wheel having a peripheral cutting edge and forming part of the severing device;

(c) introducing a counterelement, having a cutting edge forming part of the severing device, into the fiber bale and moving the counterelement relative to the fiber bale such that the counterelement penetrates underneath a tie to be severed and surrounding the fiber bale;

(d) causing the cutting wheel and the counterelement to assume an overlapping relationship;

(e) supporting the tie from below by said counterelement; and (f) severing the tie by a cooperation between the cutting edge of the cutting wheel and the counterelement.

2. A method as defined in claim 1, wherein the step of moving comprises the step of moving the counterelement underneath the wrapper surrounding the fiber bale.

3. A method as defined in claim 1, further comprising the step of maintaining the counterelement at an oblique orientation relative to a fiber bale surface while being introduced thereinto and moved relative thereto.

4. An apparatus for severing ties or a wrapper surrounding a fiber bale, comprising (a) a cutting device having (1) a rotary cutting wheel including a peripheral cutting edge;

(2) drive means for driving said rotary cutting wheel;

(3) a counterelement positioned adjacent said rotary cutting wheel in an overlapping relationship therewith; said counterelement having a cutting edge; said cutting edge of said rotary cutting wheel and said cutting edge of said counterelement cooperating with one another as shears for performing severing;

(b) supporting means for positioning the fiber bale; and (c) moving means for displacing said cutting device as a unit relative to the supporting means for causing said counterelement to penetrate into the fiber bale underneath the tie to countersupport the tie during severing of the tie by the cutting device.

5. An apparatus as defined in claim 4, wherein said counterelement is elongated and has a free end and an end opposite the free end; further comprising a support block attached to the opposite end of said counterelement.

6. An apparatus as defined in claim 5, wherein said counterelement is a spike.

7. An apparatus as defined in claim 4, wherein said rotary cutting wheel and said counterelement are supported laterally of said moving means for engaging and severing the ties on a lateral surface of the fiber bale.

8. An apparatus as defined in claim 4, wherein said cutting wheel has a rotary axis oriented perpendicularly to a direction of relative displacement between the bale and the cutting device effected by said moving means.

9. An apparatus as defined in claim 4, wherein said cutting wheel has a toothed periphery.

10. An apparatus as defined in claim 4, wherein said moving means comprises means for displacing the fiber bale on said supporting means and further wherein said rotary cutting wheel and said counterelement are stationarily held.

11. An apparatus as defined in claim 4, wherein said moving means comprises means for displacing said rotary cutting wheel and said counterelement as a unit and further wherein the fiber bale is held stationarily on said supporting means.

12. An apparatus as defined in claim 4, further comprising means for displacing said counterelement towards and away from the fiber bale transversely to a direction of the relative movement between the counterelement and the supporting means for setting a distance between the counterelement and the fiber bale.

13. An apparatus as defined in claim 4, wherein said counterelement is oriented such that upon relative movement between the fiber bale and the counterelement, the counterelement engages the tie between the tie and the fiber bale and pulls the tie away from the fiber bale.

14. An apparatus for severing ties or a wrapper surrounding a fiber bale, comprising (a) a cutting device having (1) a rotary cutting wheel including a peripheral cutting edge;

(2) drive means for driving said rotary cutting wheel;

(3) a counterelement positioned adjacent said rotary cutting wheel in an overlapping relationship therewith; said cutting edge of said rotary cutting wheel and said counterelement cooperating with one another as shears for performing severing; and (4) a cutting blade affixed to said counterelement and cooperating with said cutting wheel;

(b) supporting means for positioning the fiber bale; and (c) moving means for displacing said cutting device as a unit relative to the supporting means for causing said counterelement to penetrate into the fiber bale underneath the tie to countersupport the tie during severing of the tie by the cutting device.

15. An apparatus as defined in claim 14, wherein said cutting wheel has a toothed periphery including tooth flanks; each tooth flank extending substantially parallel to said cutting blade in a zone of cooperation between said cutting wheel and said cutting blade.

16. An apparatus as defined in claim 14, wherein said cutting device further comprises a disc having a plurality of radially outwardly projecting peripheral teeth; said disc being affixed face-to-face to said cutting wheel in axial alignment therewith; said teeth projecting beyond a periphery of said cutting wheel.

* * * * *